US009145642B2

(12) United States Patent
Kurosu et al.

(10) Patent No.: US 9,145,642 B2
(45) Date of Patent: Sep. 29, 2015

(54) COOKING PROCESS OF LIGNOCELLULOSE MATERIAL

(75) Inventors: Kazuhiro Kurosu, Tokyo (JP); Keigo Watanabe, Tokyo (JP); Takamichi Kishi, Tamano (JP)

(73) Assignees: NIPPON PAPER INDUSTRIES CO., LTD., Kita-ku, Tokyo (JP); PERMELEC ELECTRODE LTD., Fujisawa, Kanagawa (JP)

( * ) Notice: Subject to any disclaimer, the term of this patent is extended or adjusted under 35 U.S.C. 154(b) by 47 days.

(21) Appl. No.: 13/322,729

(22) PCT Filed: May 18, 2010

(86) PCT No.: PCT/JP2010/058688

§ 371 (c)(1),
(2), (4) Date: Nov. 28, 2011

(87) PCT Pub. No.: WO2010/137535

PCT Pub. Date: Dec. 2, 2010

(65) Prior Publication Data

US 2012/0067533 A1 Mar. 22, 2012

(30) Foreign Application Priority Data

May 26, 2009 (JP) ..... 2009-126103

(51) Int. Cl.
*D21C 3/02* (2006.01)
*D21C 3/24* (2006.01)

(52) U.S. Cl.
CPC *D21C 3/022* (2013.01); *D21C 3/02* (2013.01); *D21C 3/24* (2013.01)

(58) Field of Classification Search
CPC ..... D21C 3/022; D21C 3/02; D21C 3/222
USPC ..... 162/82
See application file for complete search history.

(56) References Cited

FOREIGN PATENT DOCUMENTS

JP 2000336586 A * 12/2000

OTHER PUBLICATIONS

Machine Translation of JP 2000 336586 A, Dec. 2000.*
Grace editor, Pulp and Paper Manufacture: Alkaline Pulping, 1989, The Joint Textbook Committee of the Paper Industry, vol. 5 3rd edition, pp. 49-55 and 68-71.*
Emerson Process Management,Emerson flowmeter helps BillerudKorsnäs increase process efficiency and reduce maintenance costs, Apr. 2013 [downloaded online Dec. 15, 2014].*

* cited by examiner

*Primary Examiner* — Anthony Calandra
(74) *Attorney, Agent, or Firm* — Flynn, Thiel, Boutell & Tanis, P.C.

(57) ABSTRACT

A continuous cooking process making use of a digester, which includes therein, from a top toward a bottom of the digester, a top zone, an upper cooking zone, a lower cooking zone and a cooking/washing zone and also includes strainers provided at the bottom of the respective zones and wherein a cooking black liquor extracted from at least one of the strainers is discharged to outside a digestion system, a process for cooking a lignocellulose characterized by feeding, upstream of the top of the digester, a first cooking liquor containing an alkaline cooking liquor having a specified composition, feeding a second cooking liquor of an alkaline cooking liquor made mainly of sodium hydroxide to the upper cooking zone, and feeding a third cooking liquor of an alkaline cooking liquor similar to the second cooking liquor to the cooking/washing zone.

11 Claims, 1 Drawing Sheet

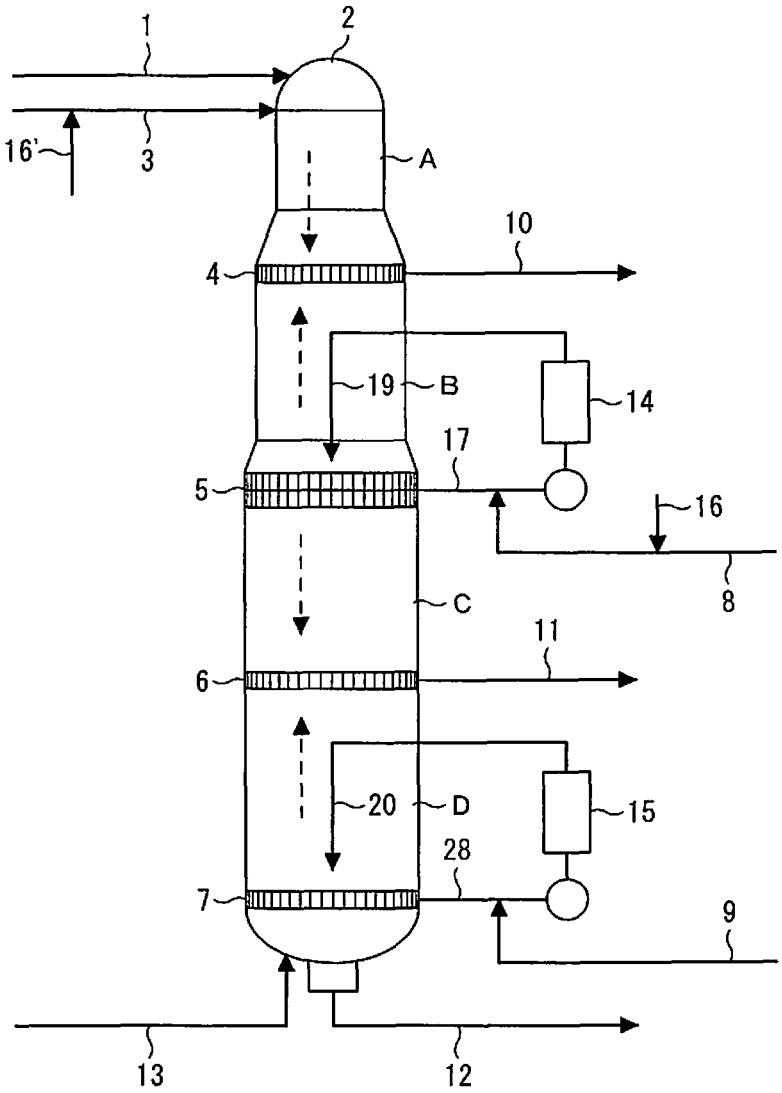
1
2
16'
3
A
10
4
19
B
14
17
5
16
8
C
11
6
20
D
15
28
7
9
13
12

COOKING PROCESS OF LIGNOCELLULOSE MATERIAL

TECHNICAL FIELD

This invention relates to a cooking process of a lignocellulose material and more particularly, to a cooking process of a lignocellulose material, which is improved in pulp yield and also more improved in the relation between the Kappa number and the pulp yield than conventional cooking processes, i.e. a cooking process of a lignocellulose material wherein pulp yield is improved at the same Kappa number, and an effective alkali addition rate at the same Kappa number can be reduced.

TECHNICAL BACKGROUND

For efficient use of wood resources, it is important to improve the yield of chemical pulp. For one of the high-yielding techniques of kraft pulp, which has become the mainstream of chemical pulp, there is known a polysulfide cooking process. Polysulfide oxidizes the carbonyl end group of carbohydrates to suppress the decomposition of the carbohydrates ascribed to a peeling reaction, thereby contributing to an improved yield. The chemical cooking liquor in the polysulfide cooking process is produced by oxidizing an alkaline aqueous solution containing sodium hydroxide and sodium sulfide, so-called white liquor, with molecular oxygen, such as in air, in the presence of a catalyst such as activated carbon or the like, e.g. by the following reaction formula (1), (Japanese Laid-open Patent Application No. S61-259754 and Japanese Laid-open Patent Application No. S53-92981).

According to this method, there can be obtained a polysulfide cooking liquor having a polysulfide concentration of about 5 g/L at a conversion rate of about 60% at a selectivity of about 60% on the sulfide ion basis. However, in a case where the conversion rate is raised according to this method, thiosulfate ions that do not contribute to cooking at all are secondarily produced in large amounts by side reactions, e.g. by the following formulas (2), (3), so that a difficulty has been involved in the production of a cooking liquor containing a high concentration of polysulfide sulfur at a high selectivity.

$$4Na_2S+O_2+2H_2O \rightarrow 2Na_2S_2+4NaOH \quad (1)$$

$$2Na_2S+2O_2+H_2O \rightarrow Na_2S_2O_3+2NaOH \quad (2)$$

$$2Na_2S_2+3O_2 \rightarrow 2Na_2S_2O_3 \quad (3)$$

On the other hand, in WO No. 95/000701 and WO No. 97/000071, there is described an electrolytic production method of an alkaline cooking liquor containing polysulfide. This method enables an alkaline cooking liquor containing a high concentration of polysulfide sulfur to be produced at a high selectivity while pronouncedly reducing secondary production of thiosulfate ions. Besides, for a method of obtaining an alkaline cooking liquor containing a high concentration of polysulfide sulfur, there is disclosed, in Japanese Laid-open Patent Application H8-311790, a method wherein molecular sulfur is dissolved in an alkaline aqueous solution containing sodium hydroxide and sodium sulfide.

Meanwhile, in order to re-use chemicals after recovery of a cooking spent liquor discharged in the production process of chemical pulp, an important issue is such that a recovery boiler has enough capacity to recover. For a factor of an increased load of the recovery boiler, there are those concerning organic matters and those concerning inorganic matters.

The load of the recovery boiler may be mitigated by improving pulp yield for the former and by reducing specific chemical consumption for the latter. Although an available capacity of a recovery boiler is ensured by re-equipping or output reduction, other methods have been demanded from the standpoint of efficiency and cost.

For a saving method of specific chemical consumption, there have been used cooking methods wherein a quinone compound, i.e. a cyclic keto compound, such as an anthraquinonesulfonate, anthraquinone, tetrahydroanthraquinone or the like, is added to a cooking system as a cooking aid (e.g. in Japanese Patent Publication No. S55-1398, Japanese Patent Publication No. S57-19239, Japanese Patent Publication No. S53-45404 and Japanese Laid-open Patent Application No. S52-37803). Quinone compounds contribute to improving delignification selectivity, reducing the Kappa number of cooked pulp, or saving chemicals, and improving the pulp yield. In Japanese Laid-open Patent H7-189153, there is disclosed a cooking process using, in combination, a quinone compound and an alkaline cooking liquor containing polysulfide, and in Japanese Laid-open Patent Application No. S57-29690, there is disclosed moderated decomposition of polysulfide with a quinone compound under heated alkaline conditions.

By the way, a technology of "leveling" of an alkali shift has been introduced according to the pioneer work, Svensk Paperstindning, 87(10): 30 (1984), made by the Swedish STFI Institute from the end of 1970's to the early 1980's. This method, which is characterized by "split addition of white liquor" and countercurrent processing, is known as "modified kraft cooking" and has been widely adopted in the field of pulp industry in 1980's. For instance, this method and its related equipment have been sold under the trademark of MCC. Later, this countercurrent method has been extended to the addition of white liquor to a countercurrent washing zone, known as high-heat washing zone", and commercially sold under the trademark of EMCC.

Furthermore, in 1990's, the Lo-Solids (registered trademark) cooking process and its related equipment have been introduced and have become subsequent drastic improvements of the kraft cooking process (U.S. Pat. Nos. 5,489,363, 5,536,366, 5,547,012, 5,575,890, 5,620,562 and 5,662,775). In this process, strong and pure cellulose pulp can be made by selectively withdrawing a spent cooking liquor at an initial stage of the pulp manufacturing process and supplementing a cooking liquor and a dilute liquor, e.g. a washer filtrate containing only a low concentration of dissolved matters.

In Japanese Laid-open Patent Application Nos. 2000-336586 and 2000-336587, there have been proposed techniques of improving pulp yield in association with such a novel cooking process. These proposals provide a cooking process of a lignocellulose material, characterized by making use of hardwood or softwood chips, adding, at a top of the digester, an alkaline cooking liquor that contains polysulfide sulfur at a sulfur concentration of 3~20 g/L and further contains 45-100 mass % of a sulfur component relative to a sulfur component of total cooking activity and contains 45-79 mass % of effective alkali relative to total alkali, respectively, contained in an alkali cooking liquor to be introduced into a digestion system, and further feeding an alkaline cooking liquor containing 0.01~5 mass % of a quinone compound based on bone-dry chip to the digester.

However, there has been a demand of further improving the pulp yield or reducing the specific chemical consumption.

DISCLOSURE OF THE INVENTION

Problem to be Solved by the Invention

The invention has for its object the provision of a cooking process of a ligonocellulose material, characterized in that a cooking black liquor is extracted from a plurality of portions of a digester and subjecting an alkaline cooking liquor to split addition to a top or given cooking zones of the digester, whereby polysulfide cooking can be carried out while contributing to an improvement in pulp yield and also to saving in cooking chemicals to the maximum extent.

Means for Solving the Problem

The invention resides in a continuous cooking process making use of a digester, which includes therein, from a top toward a bottom of the digester, a top zone, an upper cooking zone, a lower cooking zone and a cooking/washing zone and also includes strainers provided at the bottom of the respective zones and wherein a cooking black liquor extracted from at least one of the strainers is discharged to outside a digestion system, a process for cooking a lignocellulose characterized by comprising:

feeding, upstream of the top of the digester, the following first cooking liquor;

feeding the following second cooking liquor to the upper cooking zone; and feeding the following third cooking liquor to the cooking/washing zone.

First cooking liquor: an alkaline cooking liquor that is made of polysulfide, and sodium hydroxide and sodium sulfide or sodium carbonate and sodium sulfide as main components, contains polysulfide sulfur at a sulfur concentration of 3~20 g/L and contains not less than 99 mass % of a sulfur component relative to total sulfur component of cooking activity and contains 80-95 mass % of effective alkali relative to total alkali, respectively, contained in a total amount of alkali cooking liquors to be introduced into the digestion system.

Second cooking liquor: an alkaline cooking liquor made mainly of sodium hydroxide.

Third cooking liquor: an alkaline cooking liquor similar to the second cooking liquor.

Effect of the Invention

According to the invention, pulp yield is more improved and the relation between the Kappa number and the pulp yield can be further improved than in conventional cooking processes of a lignocellulose material. More particularly, according to the invention, pulp yield can be improved at the same Kappa number and an effective alkali addition rate can be reduced at the same Kappa number.

BRIEF DESCRIPTION OF THE DRAWING

FIG. 1 is a view showing an embodiment of a continuous cooking apparatus conveniently used in the present invention.

ILLUSTRATION OF REFERENCE NUMERALS

A: top zone, B: upper cooking zone, C: lower cooking zone, D: cooking/washing zone, 1: chip introduction pipe, 2: digester, 3: feed pipe of an alkaline cooking liquor containing polysulfide, 4: upper extraction strainer, 5,7: strainer, 6: lower extraction strainer, 8: upper alkaline cooking liquor feed pipe, 9: lower alkaline cooking liquor feed pipe, 10,11: black liquor discharge pipe, 12: cooked pulp discharge pipe, 13: cleaning solution introduction pipe, 14, 15: heater, 16,16': quinone compound introduction pipe, 17, 28: extraction pipe, 19: upper cooking circulation liquor, 20: lower cooking circulation liquor

MODE FOR CARRYING OUT THE INVENTION

The invention is concerned with a continuous cooking process making use of a digester, which includes therein, from a top toward a bottom of the digester, a top zone, an upper cooking zone, a lower cooking zone and a cooking/washing zone and also includes strainers provided at the bottom of the respective zones and wherein a cooking black liquor extracted from at least one of the strainers is discharged to outside the digestion system. This continuous cooking process is characterized by comprising:

feeding, upstream of the top of the digester, a first cooking liquor made of a first cooking liquor that contains polysulfide sulfur at a concentration of 3~20 g/L as sulfur and contains not less than 99 mass % of a sulfur component relative to a sulfur component of total cooking activity and contains 80~95 mass % of effective alkali relative to total alkali, respectively, contained in an alkaline cooking liquor to be introduced into the digestion system; and feeding a second cooking liquor made of an alkaline cooking liquor whose main component is sodium hydroxide to the upper cooking zone, and feeding a third cooking liquor made of an alkaline cooking liquor similar to the second cooking liquor to the cooking/washing zone.

Cooking Process

The invention makes use of a continuous cooking process using a digester, which includes therein, from a top toward a bottom of the digester, a top zone, an upper cooking zone, a lower cooking zone and a cooking/washing zone and also strainers provided at the bottom of the respective zones and wherein a cooking black liquor extracted from at least one of the strainers is discharged to outside the digestion system. The digester used herein may be a two-vessel digester wherein an impregnation vessel is set upstream of the digester. The black liquor discharged to outside the digestion system may be extracted from a strainer arranged at the bottom of the top zone.

Cooking Liquor

In the practice of the invention, alkaline cooking liquors having different formulations are added from upstream of the top of the digester (the top of the digester and/or the top of an impregnation vessel in a digester having such an impregnation vessel), from the top zone, or from another portion. For the alkaline cooking liquor used in the invention, there is used a solution whose primary components include polysulfide, and sodium hydroxide and sodium sulfide or sodium carbonate and sodium sulfide, or a solution whose main component is sodium hydroxide. The amounts of chemicals contained in the total amount of the alkaline cooking liquors introduced from the respective portions of the digester into a digestion system are at 10~25 mass % of effective alkali (mass % of $Na_2O$ relative to bone-dry chips to be fed to the digester) and at 1~10 mass % of sulfur (mass % of sulfur relative to the bone-dry chips to be fed to the digester).

First Cooking Liquor

In the invention, the first cooking liquor is added to upstream of the top of the digester, i.e. the top of the digester and/or the top of an impregnation vessel in the case where a digester has an impregnation vessel. Polysulfide contained in the first cooking liquor lacks in stability at a high temperature (not lower than 120° C.) and will decompose while consuming sodium hydroxide at the time when cooking reaches a maximum temperature. In the continuous cooking process, where an alkaline cooking liquor containing polysulfide is subjected to split-addition from different portions of the digester, the feed of the alkaline cooking liquor in the course of the cooking permits polysulfide to be exposed to high temperatures and eventually decomposed, thus disenabling pulp yield to be improved. To avoid this, according to the invention, it is necessary to add the first cooking liquor containing a polysulfide to upstream of the top of the digester, at which cooking temperature does not arrive at a maximum temperature, thereby permitting the chips to be impregnated and reacted therewith.

The first cooking liquor of the invention is one, which contains, as main components, a polysulfide, and sodium hydroxide and sodium sulfide or sodium carbonate and sodium sulfide and wherein the polysulfide sulfur is contained at a concentration, as sulfur, of 3~20 g/L, preferably 4~15 g/L. Polysulfides have the action of protecting carbohydrates and thus, contributes to improving pulp yield. However, if the polysulfide sulfur concentration in the first cooking liquor is less than 3 g/L in terms of sulfur, little contribution to improving pulp yield appears. On the other hand, if that is over 20 g/L of sulfur, a large amount of residual polysulfide does not contribute to the action of protecting carbohydrates, and decomposes as cooking arrives at maximum temperatures, simultaneously with the consumption of sodium hydroxide necessary for the cooking. Eventually, an alkali component necessary for the cooking cannot be secured, with the result that cooking per se does not proceed and the Kappa number of the resulting pulp becomes very high.

Further, the first cooking liquor of the invention has a prominent feature in that aside from polysulfide sulfur present at a concentration of 3~20 g/L as sulfur, there are contained not less than 99 mass % of a sulfur component relative to a sulfur component of total cooking activity and 80~95 mass % of effective alkali relative to total alkali, respectively, contained in an alkali cooking liquor to be introduced into a digestion system. This enables a very good Kappa number and pulp yield to be obtained, and an effective alkali addition rate can be reduced. Moreover, it is more preferred to contain 100 mass % of a sulfur component based on the sulfur component of total cooking activity contained in the total amount of alkali cooking liquors to be introduced into the digestion system.

Preferably, the first cooking liquor should contain an anode liquor obtained by electrochemically oxidizing an alkaline solution having sodium hydroxide and sodium sulfide, or sodium carbonate and sodium sulfide as main components, and also an alkaline cooking solution made of an alkaline solution that has sodium hydroxide and sodium sulfide, or sodium carbonate and sodium sulfide as main components and is not electrochemically oxidized. As a target for the electrochemical oxidation treatment (electrolytic treatment), all types of alkaline solutions that contain sodium sulfide and run through a manufacturing process of lignocellulose material. In this case, although the total amount of the alkaline solutions containing sodium sulfide served for cooking may be subjected to electrolytic treatment, the electrolytic treatment amount can be optimized depending on the manner of cooking and the amount of a cathode liquor necessary for second and third cooking liquors described hereinafter.

The anode liquor obtained by electrochemically oxidizing an alkaline solution having sodium hydroxide and sodium sulfide, or sodium carbonate and sodium sulfide as main components in the first cooking liquor is preferably present within a range of 30~100 mass % relative to the total amount of the first cooking liquor, and the alkaline cooking liquor obtained by not subjecting, to electrochemical oxidation, an alkaline cooking liquor having sodium hydroxide and sodium sulfide, or sodium carbonate and sodium sulfide as main components is preferably present within a range of 0~30 mass % relative to the total amount of the first cooking liquor. This is for the reason that for second and third cooking liquors as will be described hereinafter, there is provided a cathode solution that is obtained by electrochemically oxidizing an alkaline solution having sodium hydroxide and sodium sulfide, or sodium carbonate and sodium sulfide as main components.

The ratio of the anode liquor obtained by electrochemically oxidizing an alkaline solution having, as main components, sodium hydroxide and sodium sulfide, or sodium carbonate and sodium sulfide should preferably be at not less than 80 mass % relative to the total amount of the first cooking liquor. This is because part of the cathode liquor can be used as an alkali source of an oxygen delignification step in a lignocellulose material manufacturing process.

As an alkali source of the oxygen delignification step, there is ordinarily used an oxidized white liquor, i.e. chemicals obtained by air-oxidizing, to thiosulfate, a sulfur-containing atomic group in a white liquor in the presence of a catalyst. This has a problem in that since sodium sulfide in the white liquor is oxidized to sodium thiosulfate ($Na_2S_2O_3$), an alkali source serving as an active alkali is deactivated and lost.

With the electrolytic treatment, there is little loss of the active alkali, under which if a cathode liquor obtained by the electrolytic treatment can be achieved instead of oxidized white liquor, such a problem of deactivating active alkali can be solved, thus being more preferred.

Method of Producing First Cooking Liquor

A polysulfide-containing alkaline cooking liquor used as the first cooking liquor of the invention can be produced by a hitherto employed air-oxidation method. However, the air-oxidation method is disadvantageous in that a side reaction of causing part of the polysulfide to be converted to sodium thiosulfate occurs ascribed to the air oxidation of polysulfide. Accordingly, it is preferred to produce the liquor by a method of electrochemically oxidizing sulfide ions in a sulfide ion-containing solution such as an alkaline cooking liquor whose main components are sodium hydroxide and sodium sulfide, or sodium carbonate and sodium sulfide, i.e. by an electrolytic method.

In the practice of the invention, there can be preferably applied electrolytic methods described in (A) Japanese Laid-open Patent Application No. H10-166374, (B) Japanese Laid-open Patent Application No. H11-51016 and (C) Japanese Laid-open Patent Application No. H11-51033. These methods have been previously developed by the present inventors, and as to the electrolytic method, an arrangement of the anode, requirements for anode spacing in an anode compartment, pressure conditions inside a cathode compartment and an anode compartment and other various requirements have been investigated and studied. Eventually, important requirements for obtaining significant effects such as reducing by-produced thiosulfate ions to an extreme extent have been found, thereby configuring the methods.

The polysulfide sulfur used herein means zero-valence sulfur, for example, in sodium polysulfide, $Na_2S_x$, i.e. (x−1) sulfur atoms. It will be noted that in the present specification, the volume unit of liter is expressed by L. In addition, the generic term including sulfur corresponding to sulfur having the oxidation number of −2 in polysulfide ion (polysulfide) (one sulfur atom per $Sx^{2-}$ or $Na_2S_x$) and sulfide ion ($S^{2-}$) is expressed in this specification appropriately as $Na_2S$ sulfur. In this sense, polysulfide means a combination of polysulfide sulfur and $Na_2S$ sulfur, and $Na_2S$ sulfur means sulfur from $Na_2S$ chosen out of sodium sulfide ($Na_2S$) and $Na_2S_x$, and cooking-active sulfur means a combination of polysulfide sulfur and $Na_2S$ sulfur selected among from sulfur components contributing to cooking reaction.

These technologies (A)~(C) are particularly suited to produce polysulfide by treating a white liquor (an alkaline solution containing sodium hydroxide and sodium sulfide as main components) or a green liquor (an alkali solution containing sodium carbonate and sodium sulfide as main components) in the pulp manufacturing procedure, and also to obtain an alkali solution containing sodium hydroxide as a main component. In the practice of the invention, a white liquor or green liquor is introduced into an anode compartment or an anode side of an electrolytic vessel, and polysulfide formed herein can be utilized by adding, as it is or after causticization, to upstream of a digester top (before arrival of chips at a maximum temperature). Moreover, an alkali solution containing sodium hydroxide as a main component (and also containing a small amount of potassium hydroxide), which is formed in a cathode compartment or a cathode side of the electrolytic vessel, can be used by addition to an upper cooking zone and zones following it (after arrival of the chips at a maximum temperature).

These methods are now described mainly with respect to the technical content and various embodiments of (A), which is effective to the techniques of (B)~(C). An alkaline cooking liquor containing sodium hydroxide and sodium sulfide as main components is continuously fed to an anode compartment of an electrolyzer having an anode compartment disposing an anode therein, a cathode compartment disposing a cathode therein, and a membrane for partition between the anode compartment and the cathode compartment.

Anode

The anode material is not critical in type so far as it is resistant to oxidation in an alkali, and nonmetals or metals may be used therefor. As a nonmetal, mention is made, for example, of carbon materials and as a metal, mention is made, for example, of base metals such as nickel, cobalt, titanium and the like, and alloys thereof, noble metals such as platinum, gold, rhodium and the like, and alloys or oxides thereof. As to an anode structure, there can be preferably used a porous anode having a physically three-dimensional network structure. In particular, with a nickel anode material, for example, there can be mentioned porous nickel obtained by subjecting a foamed polymer material to nickel plating at a skeleton thereof and removing the inner polymer material by baking.

With such a porous anode having a physically three-dimensional network structure, there is arranged, in an anode compartment, a porous anode, which has a physically continuous three-dimensional network structure at least a surface of which is made of nickel or a nickel alloy having not less than 50 mass % of nickel and which has a surface area of 500-20000 $m^2/m^3$ per unit volume of the anode compartment. Since at least a surface portion of the anode is made of nickel or a nickel alloy, durability is sufficient to withstand practical applications in the manufacture of the polysulfide.

Although the anode surface is preferably made of nickel, a nickel alloy having not less than 50 mass % of nickel may also be used and a nickel content is more preferably at not less than 80 mass %. Nickel is relatively inexpensive and its elution potential or oxide formation potential is higher than a formation potential of polysulfide sulfur or thiosulfate ions, for which this is a favorable electrode material in obtaining polysulfide ions by electrolytic oxidation.

In a case where such a porous, three-dimensional network structure, thus having a large surface area, is used as an anode, an intended electrolytic reaction takes place over the entire electrode surface, thereby enabling the formation of by-products to be suppressed. Moreover, the anode has a physically continuous network structure, unlike a fiber assembly, so that it exhibits satisfactory electric conductivity for use as an anode and an IR drop in the anode can be lessened, thereby ensuring a lower cell voltage. Since the anode has good electrical conductivity, it becomes possible to make a large porosity of the anode and thus, a pressure drop can be made small.

The surface area of the anode per unit volume of the anode compartment should be at 500~20000 $m^2/m^3$. The volume of the anode compartment used herein means a volume of a portion partitioned between an effective current-carrying face of the membrane and a current collector plate. If the surface area of the anode is smaller than 500 $m^2/m^3$, the current density in the anode surface inconveniently becomes so large that not only side products such as thiosulfate ions are apt to be formed, but also nickel is prone to anodic dissolution. The surface area of the anode made larger than 20000 $m^2/m^3$ is unfavorable because of a concern that there is involved a problem on such electrolytic operations that a pressure drop of the liquor increases. The surface area of the anode per unit volume of the anode compartment is more preferably within a range of 1000~10000 $m^2/m^3$.

The surface area of the anode is preferably at 2~100 $m^2/m^2$ per unit area of the membrane partitioning between the anode compartment and the cathode compartment. The surface area of the anode is more preferably at 5~50 $m^2/m^2$ per unit area of the membrane. The average pore size of the network of the anode is preferably at 0.1~5 mm. If the average pore size of the network is larger than 5 mm, the surface area of the anode cannot be increased and thus, a current density in the anode surface becomes large. As a consequence, not only are side products such as thiosulfate ions liable to be formed, but also nickel is prone to anodic dissolution, thus being unfavorable. The average pore size of the network smaller than 0.1 mm is unfavorable because of concern that there is involved a problem on such electrolytic operations that a pressure drop of the liquor increases. The average pore size of the anode network is more preferably at 0.2~2 mm.

The anode of a three-dimensional network structure preferably has a diameter of wire strands of the network of 0.01~2 mm. A diameter of the wire strand smaller than 0.01 is unfavorable because a severe difficulty is involved in its manufacture, along with expensiveness and unease in handling. If the diameter of the wire strand exceeds 2 mm, an anode having a large surface area cannot be obtained, resulting unfavorably in an increased current density in the anode surface and the likelihood of forming side products such as thiosulfate ions. More preferably, the diameter of the wire strands forming the network is at 0.02~1 mm.

The anode may be disposed fully in the anode compartment in contact with the membrane, or may be disposed at some space between the anode and the membrane. Since a liquor to be treated has to be run through the anode, the anode should preferably have an adequate space. In any cases, the porosity of the anode is preferably at 90~99%. If the porosity is less than 90%, a pressure loss at the anode unfavorably becomes great. A porosity exceeding 99% is unfavorable because a difficulty is involved in making a large anode surface area. More preferably, the porosity is at 90~98%.

In this regard, in the technique described in the aforeindicated Japanese Laid-open Patent Application H11-51033 (C), it has been found that when using a porous anode, important requirements exist between the porous anode and the membrane and also between the volume of the anode compartment and the apparent volume of the porous anode for producing, while keeping a high selectivity, a cooking liquor that is much reduced in the formation of secondarily produced thiosulfate ions contains a high concentration of polysulfide and is rich in residual $Na_2S$ sulfur, such requirements being properly set. In this technique, many effects can be obtained as set out hereinbefore including an effective increase in pulp yield by using the resulting polysulfide cooking liquor for digestion.

The current density at the membrane surface in operation is preferably at 0.5~20 kA/m$^2$. If the current density at the membrane is less than 0.5 kA/m$^2$, an unnecessary large-capacity electrolysis equipment is unfavorably needed. In case where the current density at the membrane surface exceeds 20 kA/m$^2$, not only side products such as thiosulfuric acid, sulfuric acid, oxygen and the like increase in amount, but also there is concern that nickel undergoes anodic dissolution, thus being unfavorable. The current density of 2~15 kA/m$^2$ at the membrane surface is more preferred. Since there is used an anode having a great surface area relative to the area of the membrane, operations can be carried out within a small range of the current density at the anode surface.

Since this anode has a great surface area, the current density at the anode surface can be made small. When a current density at the anode surface is calculated from the surface area of the anode on the assumption that the current densities at the surfaces of the respective portions of the anode are uniform, the value is preferably within a range of 5~3000 A/m$^2$. A more preferred range is at 10~1500 A/m$^2$. The current density of less than 5 A/m$^2$ at the anode surface is unfavorable because of the necessity of an unnecessary large-capacity electrolysis equipment. The current density exceeding 3000 A/m$^2$ at the anode surface is also unfavorable because not only by-products such as thiosulfuric acid, sulfuric acid and oxygen increase in amount, but also there is concern that nickel undergoes anodic dissolution.

This anode has a physically continuous network structure and also has a satisfactory electrical conductivity, unlike a fiber assembly, so that the porosity of the anode can be increased while keeping a small IR drop in the anode. Hence, the pressure drop of the anode can be lessened.

The stream of a liquor in the anode compartment should preferably be kept as it is a small streamline flow in the sense of making a small pressure drop. However, with the streamline flow, the anode liquor is not agitated in the anode compartment and deposits may be accumulated at the membrane in contact with the anode compartment in some case, with the likelihood of raising the cell voltage over time. In this case, the pressure drop of the anode can be made small even if the anode liquor is set at a large flow rate, with the attendant advantage that the anode liquor is agitated in the vicinity of the membrane surface and deposits are unlikely to be accumulated. The average flow rate in the anode compartment is preferably at 1~30 cm/second. Although the flow rate of a cathode liquor is not critical and is determined depending on the magnitude of floating force of a generated gas. The average flow rate in the anode compartment is more preferably within a range of 1~15 cm/second, most preferably within a range of 2~10 cm/second.

Cathode

The cathode materials preferably include alkali-resistant materials and there can be used, for example, nickel, Raney nickel, steels, stainless steels and the like. The cathode used may be in the form of a flat sheet or a mesh alone, or a plurality thereof as a multi-layered arrangement. Alternatively, there may be used a three-dimensional electrode obtained by combining wire electrodes. For an electrolyzer, there may be used an electrolyzer of a dual-compartment type consisting of one anode compartment and one cathode compartment, or an electrolyzer using a combination of three or more compartments. A number of electrolyzers may be arranged to have a monopolar structure or a bipolar structure.

Membrane

As a membrane partitioning between the anode compartment and the cathode compartment from each other, a cation exchange membrane is preferably used. The cation exchange membrane allows cations to be introduced from the anode compartment into the cathode compartment, thereby impeding movement of sulfide ions and polysulfide ions. Polymer membranes of the type wherein a cation exchange group such as a sulfone group, a carboxylic group or the like is introduced into hydrocarbon or perfluoro resin-based polymers are preferably used as a cation exchange membrane.

Electrolytic Conditions

Electrolytic conditions such as temperature, current density and the like are preferably so controlled and kept as to permit polysulfide ions ($Sx^{2-}$), i.e. polysulfide ions such as $S_2^{2-}$, $S_3^{2-}$, $S_4^{2-}$, $S_5^{2-}$ and the like, to be formed as oxide products of sulfide ions without forming secondarily produced thiosulfate ions. In doing so, an alkaline cooking liquor having a polysulfide sulfur concentration of 5~20 g/L as sulfur can be formed at a high efficiency according to an electrolytic oxidation method of sodium sulfide substantially without the formation of a thiosulfate ion by-product. As a matter of course, proper selection of electrolytic conditions, such as temperature, current density and the like, enables the formation of an alkaline cooking liquor having a polysulfide sulfur concentration less than 8 g/L.

Second, Third Cooking Liquors

In the practice of the invention, a second cooking liquor is fed to the upper cooking zone. The second cooking liquor is one made mainly of sodium hydroxide.

Further, according to the invention, a third cooking liquor is fed to the cooking/washing zone that is a latter stage of digestion. The third cooking liquor is an alkaline cooking liquor similar to the second cooking liquor.

Although any type of alkaline cooking liquor may be used as the second and third cooking liquors so far as sodium hydroxide is contained as a main component, it is preferred to use a cathode liquor, which is obtained by electrolytically oxidizing, into polysulfide, sulfide ions in a solution containing the sulfide ions such as an alkaline cooking liquor containing sodium hydroxide and sodium sulfide, or sodium carbonate and sodium sulfide as main components.

Although caustic soda brought in from outside may also be used as the second and third cooking liquors, chemicals discharged from the cooking process are ordinarily recovered in a recovery boiler, with the attendant problem that the caustic soda brought in from outside disturbs the balance of a chemical recovery system.

On the other hand, there may be used, as the second and third cooking liquors, an oxidized white liquor ordinarily used as an alkali source in an oxygen delignification step of a lignocellulose material producing process, i.e. chemicals obtained by subjecting a sulfur-containing atomic group in the white liquor to air oxidation to thiosulfuric acid in the presence of a catalyst. Because of the alkali source derived from the white liquor, this can be used without disturbing the balance of a chemical recovery system. Nevertheless, since sodium sulfide in the white liquor is oxidized to sodium thiosulfate ($Na_2S_2O_3$) as set out above, a problem is involved in that the alkali source serving as an active alkali is deactivated, resulting in a loss thereof.

As stated above, according to the invention, it becomes possible to satisfy both the need to efficiently produce alkaline liquors that contribute to optimization of a cooking process and have different formulations and the need to hold the balance of a chemical recovery system.

Quinone Compound

In the practice of the invention, it is preferred from the standpoint of saving chemicals and improving pulp yield to supply, to a digester, an alkaline cooking liquor containing 0.01~1.5 mass % of a quinone compound relative to bone-dry chips. Especially, the feed of a quinone compound at an initial stage of cooking with a high-concentration polysulfide, i.e. upstream of the top of the digester or at the upper cooking zone, is very effective for the cooking step. More particularly, the co-existence of a polysulfide and a quinone compound at an initial stage of cooking promotes sugar stabilization and a delignification rate in the cooking step, and enables a remarkable improvement in pulp yield and saving of specific chemical consumption along with a reduction in boiler load ascribed to organic and inorganic matters.

Usable quinone compounds include quinone compounds, hydroquinone compounds or precursors thereof, which are known as a so-called digestive aid, and at least one compound selected therefrom can be used. These compounds include, for example, quinone compounds such as anthraquinone, dihydroanthraquinone (e.g. 1,4-dihydroanthraquinone), tetrahydroanthraquinone (e.g. 1,4,4a,9a-tetrahydroanthraquinone, 1,2,3,4-tetrahydoanthraquinone), methylanthraquinone (e.g. 1-methylanthraqunone, 2-methylanthraquinone), methyldihydroanthraquinone (e.g. 2-methyl-1,4-dihdyroanthraquinone), methyltetrahydroanthraquinone (e.g. 1-methyl-1,4,4a,9a-tetrahydroanthraquinone, 2-methyl-1,4,4a,9a-tetrahydroanthraquinone) and the like, hydroquinone compounds such as anthrahydroquinone (9,10-dihdyroxyanthracene in general), methylanthrahydroquinone (e.g. 2-methylanthrahydroquinone), dihydroanthrahydroanthraquinone (e.g. 1,4-dihydro-9,10-dihydroxyanthracene), and alkali metal salts thereof (e.g. a disodium salt of anthrahydroquinone, a disodium salt of 1,4-dihydro-9,10-dihdyroxanthracene) and the like, and precursors such as anthrone, anthranol, methylanthraone, methylanthranol and the like. These precursors have the possibility of being converted to quinone compounds or hydroquinone compounds under cooking conditions.

Lignocellulose Material

As a lignocellulose material used in the invention, there are used softwood or hardwood chips and any sort of tree may be used. For instance, mention is made of spruce, douglas fir, pine, cedar and the like for softwood, and *eucalyptus*, beech, Japanese oak and the like for hardwood.

Preferred embodiments of the invention are now described, to which the invention should not be construed as limited to. FIG. 1 is a view showing an embodiment of a continuous digester for carrying out the Lo-Solids (registered trademark) method conveniently used in the invention. A digester 2 per se is broadly divided, from the top toward the bottom thereof, into a top zone A, an upper cooking zone B, a lower cooking zone C and a cooking/washing zone D. A strainer is provided at the bottoms of the respective zones including an extraction strainer 4 at the bottom of the first top zone A, a strainer 5 at the bottom of the second upper cooking zone B, a lower extraction strainer 6 at the bottom of the third lower cooking zone C and a strainer 7 at the bottom of the fourth cooking/washing zone D.

Chips are supplied to the top of the digester 2 through a chip-introducing pipe 1 and placed in the top zone A. On the other hand, a first alkaline cooking liquor containing a polysulfide and sodium hydroxide as main components is fed to the top of the digester 2 through a polysulfide-containing alkaline cooking liquor feed pipe 3. The chips supplied and filled at the top of the digester 2 are moved down along with the cooking liquor, during which the first cooking liquor effectively acts so as to permit initial delignification to occur, thereby causing lignin to be dissolved out from the chips into the cooking liquor. A given amount of a cooking black liquor containing lignin from the chips is extracted from the upper extraction strainer 4 and passed to a recovery step through a black liquor discharge pipe 10.

The chips moved down from the top zone A enter into the upper cooking zone B. In this zone, the chips arrive at a maximum cooking temperature and delignification is allowed to proceed further. The cooking black liquor from the strainer 5 provided at the bottom of the upper cooking zone B is extracted from an extraction liquor pipe 17. In the extraction liquor pipe 17, this extracted cooking black liquor is combined with a second cooking liquor, i.e. an alkaline cooking liquor running through an upper alkaline cooking liquor feed pipe 8, and a quinone compound-containing liquor fed from a quinone compound feed pipe 16, and is heated by means of a heater 14 provided at a flow path. This circulation liquor (upper cooking circulation liquor) is supplied in the vicinity of the strainer 5 at the bottom of the upper cooking zone B via an upper cooking circulation pipe 19.

In the upper cooking zone B, the chips move downward toward the upper portion of the strainer 5 from the bottom of the upper extraction strainer 4, during which the circulation cooking liquor fed from the circulation liquor pipe 19 in the vicinity of the strainer 5 rises toward the upper extraction strainer 4 and the deliginification reaction proceeds according to the countercurrent cooking by the action of this second cooking liquor. The circulation cooking liquor rising towards the upper extraction strainer 4 turns into a black liquor, which is extracted from the upper extraction strainer 4, followed by passing to a recovery step via a black liquor discharge pipe 10. The chips delignified in the upper cooking zone B pass into the lower cooking zone C at the lower portion of the strainer 5 and undergo further delignification by concurrent cooking with the second cooking liquor. The cooking black liquor obtained in this zone is extracted from the lower extraction strainer 6 at the bottom of the lower cooking zone C and pass to the recovery step via a black liquor discharge pipe 11.

The chips moved downward from the lower cooking zone C enter into the cooking/washing zone D. In this zone, the chips undergoes countercurrent cooking, resulting in further proceeding of lignification. The cooking black liquor extracted from the strainer 7 provided at the lower portion of the cooking/washing zone D and in the vicinity of the bottom of the digester is combined in the extraction liquor pipe 18 with an alkaline cooking liquor, which passes through a lower alkaline cooking liquor feed pipe 9 and contains, as main components, sodium hydroxide and sodium sulfide or, as a main component, sodium hydroxide, and is heated by means of a heater 15 provided at the flow path. This circulation liquor is fed in the vicinity of a strainer 7 through a lower circulation liquor pipe 20.

In the cooking/washing zone D, the chips move downward from the lower extraction strainer 6 toward the strainer 7. During the movement, the circulation cooking liquor fed from a lower circulation liquor pipe 20 in the vicinity of the strainer 7 rises toward the lower extraction strainer 6 and the cooking black liquor is extracted from the lower extraction strainer 6 and passed to the recovery step via the black liquor discharge pipe 11. In this zone, the cooking reaction is completed to obtain pulp through the cooked pulp discharge pipe 12.

The digester 2 has an initial temperature of about 120° C. at the top zone A thereof and is heated over the bottom of the top zone A to a cooking maximum temperature within a range of 140~170° C., the upper cooking zone B and the lower cooking zone C are kept at a maximum temperature within a range of 140~170° C., respectively, and in the cooking/washing zone D, its temperature is lowered from the cooking maximum temperature within a range of 140~170° C. to about 140° C. over the bottom of the cooking/washing zone.

EXAMPLES

The invention is now described in detail on the basis of examples, which should not, of course, be construed as limiting the invention thereto.

Index of Cooking

H-factor (HF) was taken as an index for cooking. The H-factor means an indication of the total amount of heat given to a reaction system in the course of cooking, and is expressed according to the following formula in the present invention.

$$HF = \int \ln^{-1}\left[43.20 - \frac{16113}{T}\right] dt$$

In the formula, HF represents an H-factor, T represents an absolute temperature at a certain time, and dt is a function of time that changes with time according to a temperature profile in a digester. The H-factor can be calculated by subjecting the term of the right side from the integral sign to time integration from a time, at which chips and an alkaline cooking liquor are mixed tougher, to a completion time of cooking.

Testing and Measuring Methods

The pulp yield of the resulting unbleached pulp was measured in terms of a yield of screened pulp from which reject had been removed. The Kappa number of unbleached pulp was determined according to the TAPPI test method T236os-76. The polysulfide concentration in terms of sodium sulfide and sulfur conversions in an alkaline cooking liquor was quantitatively determined according to the TAPPI test method T624hm-85. The pulp yield was one that was obtained by adding a carbohydrate yield determined by the TAPPI test method 249hm-85, an alcohol/benzene extraction content of pulp determined by the TAPPI test method T204os-76, and an acid-insoluble lignin content determined by the TAPPI test method T222os-74 together.

Example 1

Using chips obtained by mixing 40 mass % of radiata pine, 30 mass % of Douglas fir and 30 mass % of larch, each on a bone-dry weight basis, cooking was carried out by use of a continuous digester shown in FIG. 1. Three total effective alkali addition rates (relative to bone-dry chips; converted to $Na_2O$) of 14.5, 16.5 and 18.5 mass % were used. A first cooking liquor having the following formulation was added to the top of the digester. A liquor ratio to the bone-dry chips was at about 3.5 L/kg as combined along with the moisture accompanied with the chips.

First cooking liquor: an alkaline cooking liquor (a polysulfide sulfur concentration of 4 g/L (converted to sulfur, a concentration in a whole alkaline cooking liquor herein and whenever it appears hereinafter), a sodium hydroxide concentration of 70 g/L (converted to $Na_2O$), and a sodium sulfide concentration of 20 g/L (converted to $Na_2O$)), which is obtained by mixing an amount of an anode liquor obtained by electrochemically oxidizing, with the following electrolyzer, 36 mass % of an alkaline liquor containing sodium hydroxide and sodium sulfide as main components and 64 mass % of an alkaline cooking liquor containing sodium hydroxide and sodium sulfide as main components but not subjected to electrolytic oxidation, and which contains 100 mass % of sulfur (active sulfur for cooking herein and whenever it appears hereinafter) and 93 mass % of effective alkali relative to the whole amount of the alkaline cooking liquors introduced into the cooking system.

The electrolyzer was so arranged as set out below. A two-compartment electrolyzer was assembled including a nickel porous body as an anode (anode surface area per unit volume of an anode compartment: 5600 $m^2/m^3$, an average pore size of a network: 0.51 mm, and a surface area relative to unit membrane area: 28 $m^2/m^2$), an iron expansion metal as a cathode and a perfluoro resin-based cation exchange membrane as a membrane.

45 volume % of a cooking black liquor sent from the digester directly to the recovery step was extracted with the extraction strainer. The cathode liquor obtained from the electrolyzer was added as a second cooking liquor in such a way that an effective alkali was in an amount of 4.5 mass % of the total amount of the alkaline cooking liquors introduced into the cooking system. 55 volume % of the whole cooking black liquor was extracted from the lower extraction strainer. A liquor of the same type as the second cooking liquor was added as a third cooking liquor in such a way that effective alkali was at 1.5 mass % relative to the total amount of the alkaline cooking liquors introduced into to cooking system.

The cooking was conducted to an extent of an H-factor of 1400 by heating the top zone from 120° C.~140° C. in 30 minutes over from the top of the top zone to the bottom, keeping the upper cooking zone at 156° C. for 50 minutes, keeping the lower cooking zone at 156° C. for 160 minutes, and decreasing the temperature of the cooking/washing zone from 156° C.~140° C. in 170 minutes over from the top of the cooking/washing zone to the bottom.

1,4,4a,9a-Tetrahydroquinone used as a quinone compound was mixed with the first cooking liquor added at the top of the digester in an amount of 0.05 mass % relative to the bone-dry chips. The results of the cooking of Example 1 are shown in Table 1.

Example 2

This example was carried out in the same manner as in Example 1 with respect to the chips used for the cooking, the total effective alkali addition rates, the liquor ratios, the electrolyzer used for electrolysis, the cooking black liquor extraction from the upper and lower extraction strainers, the temperatures, the times and the H-factor of the digester, and the addition of the quinone compound. A first cooking liquor having the following formulation was added to the top of the digester.

First cooking liquor: an alkaline cooking liquor (a polysulfide sulfur concentration of 8 g/L (converted to sulfur), a sodium hydroxide concentration of 70 g/L (converted to $Na_2O$), and a sodium sulfide concentration of 13 g/L (converted to $Na_2O$)), which is obtained by mixing an amount of an anode liquor obtained by electrochemically oxidizing, with the above-indicated electrolyzer, 72 mass % of an alkaline liquor containing sodium hydroxide and sodium sulfide as main components and 28 mass % of an alkaline cooking liquor containing sodium hydroxide and sodium sulfide as main components but not subjected to electrolytic oxidation, and which contains 100 mass % of sulfur and 85 mass % of effective alkali relative to the amount of the alkaline cooking liquors to be introduced into the cooking system.

A second cooking liquor as used in Example 1 was added to the bottom of the upper cooking zone in such an amount that effective alkali were at 11.2 mass % relative to the total amount introduced into the cooking system. A third cooking liquor of the same type as the second cooking liquor was added to the bottom of the cooking/washing zone so that effective alkali were at 3.8 mass % relative to the total amount of the alkaline cooking liquors introduced into the cooking system.

The results of the cooking of Example 2 are shown in Table 1.

Example 3

This example was carried out in the same manner as in Example 1 with respect to the chips used for the cooking, the total effective alkali addition rates, the liquor ratios, the electrolyzer used for electrolysis, the cooking black liquor extraction from the upper and lower extraction strainers, the temperatures, the times and the H-factor of the digester, and the addition of the quinone compound. A first cooking liquor having the following formulation was added to the top of the digester.

First cooking liquor: an alkaline cooking liquor (a polysulfide sulfur concentration of 10 g/L (converted to sulfur), a sodium hydroxide concentration of 70 g/L (converted to $Na_2O$), and a sodium sulfide concentration of 10 g/L (converted to $Na_2O$)), which is obtained by mixing a whole amount of an anode liquor obtained by electrochemically oxidizing, with the above-indicated electrolyzer, 90 mass % of an alkaline liquor containing sodium hydroxide and sodium sulfide as main components and 10 mass % of an alkaline cooking liquor containing sodium hydroxide and sodium sulfide as main components but not subjected to an electrolytic oxidation, and which contains 100 mass % of sulfur and 80 mass % of effective alkali relative to the amount of the alkaline cooking liquors to be introduced into the cooking system.

A second cooking liquor as used in Example 1 was added to the bottom of the upper cooking zone in such an amount that effective alkali were at 15 mass % relative to the total amount introduced into the cooking system. As a third cooking liquor, the same type of liquor as the second cooking liquor was added to the bottom of the cooking/washing zone so that effective alkali were at 5 mass % relative to the total amount of the alkaline cooking liquors introduced into the cooking system.

The results of the cooking of Example 3 are shown in Table 1.

Comparative Example 1

This comparative example was carried out in the same manner as in Example 1 with respect to the chips used for the cooking, the total effective alkali addition rates, the liquor ratios, the electrolyzer used for electrolysis, the cooking black liquor extraction from the upper and lower extraction strainers, the temperatures, the times and the H-factor of the digester, and the addition of the quinone compound. A first cooking liquor having the following formulation was added to the top of the digester.

First cooking liquor: an alkaline cooking liquor (a polysulfide sulfur concentration of 4 g/L (converted to sulfur), a sodium hydroxide concentration of 70 g/L (converted to $Na_2O$), and a sodium sulfide concentration of 18 g/L (converted to $Na_2O$)), which is obtained by mixing an amount of an anode liquor obtained by electrochemically oxidizing, with the above-indicated electrolyzer, 36 mass % of an alkaline liquor containing sodium hydroxide and sodium sulfide as main components and 56 mass % of an alkaline cooking liquor containing sodium hydroxide and sodium sulfide as main components but not subjected to an electrolytic oxidation, and which contains 91 mass % of sulfur and 85 mass % of effective alkali relative to the amount of the alkaline cooking liquors to be introduced into the cooking system.

As a second cooking liquor, an alkaline cooking liquor having 15.9% sulfidity which is obtained by mixing an amount of a cathode liquor obtained by electrolysis, with 8 mass % of an alkaline liquor containing sodium hydroxide and sodium sulfide as main components but not subjected to electrolytic oxidation was added to the bottom of the upper cooking zone so that effective alkali were at 11.2 mass % relative to the total amount of the alkaline cooking liquors introduced into the cooking system. As a third cooking liquor, the same type of liquor as the second cooking liquor was added to the bottom of the cooking/washing zone so that effective alkali were at 3.8 mass % relative to the total amount of the alkaline cooking liquors introduced into the cooking system.

The results of the cooking of Comparative Example 1 are shown in Table 2.

Comparative Example 2

This comparative example was carried out in the same manner as in Example 1 with respect to the chips used for the cooking, the total effective alkali addition rates, the liquor ratios, the electrolyzer used for electrolysis, the cooking black liquor extraction from the upper and lower extraction strainers, the temperatures, the times and the H-factor of the digester, and the addition of the quinone compound. A first cooking liquor having the following formulation was added to the top of the digester.

First cooking liquor: an alkaline cooking liquor (a polysulfide sulfur concentration of 8 g/L (converted to sulfur), a sodium hydroxide concentration of 70 g/L (converted to $Na_2O$), and a sodium sulfide concentration of 11 g/L (converted to $Na_2O$)), which is obtained by mixing an amount of an anode liquor obtained by electrochemically oxidizing, with the above-indicated electrolyzer, 72 mass % of an alkaline liquor containing sodium hydroxide and sodium sulfide as main components and 18 mass % of an alkaline cooking liquor containing sodium hydroxide and sodium sulfide as main components but not subjected to electrolytic oxidation and which contains 87 mass % of sulfur and 75 mass % of effective alkali relative to the amount of the alkaline cooking liquors to be introduced into the cooking system.

As a second cooking liquor, an alkaline cooking liquor having 12.4% sulfidity which is obtained by mixing an amount of a cathode liquor obtained by electrolysis, with 10 mass % of a remaining alkaline liquor which was not used for electrolysis was added to the bottom of the upper cooking zone so that effective alkali were at 18.7 mass % relative to the total amount of the alkaline cooking liquors introduced into the cooking system. As a third cooking liquor, the same type of liquor as the second cooking liquor was added to the bottom of the cooking/washing zone so that effective alkali were at 6.3 mass % relative to the total amount of the alkaline cooking liquors introduced into the cooking system.

The results of the cooking of Comparative Example 2 are shown in Table 2.

Comparative Example 3

This comparative example was carried out in the same manner as in Example 1 with respect to the chips used for the cooking, the total effective alkali addition rates, the liquor ratios, the electrolyzer used for electrolysis, the cooking black liquor extraction from the upper and lower extraction strainers, the temperatures, the times and the H-factor of the digester, and the addition of the quinone compound. A first cooking liquor having the following formulation was added to the top of the digester.

First cooking liquor: an alkaline cooking liquor (a polysulfide sulfur concentration of 10 g/L (converted to sulfur), a sodium hydroxide concentration of 70 g/L (converted to $Na_2O$), and a sodium sulfide concentration of 11 g/L (converted to $Na_2O$)), which is obtained by mixing an amount of an anode liquor obtained by electrochemically oxidizing, with the above-indicated electrolyzer, 90 mass % of an alkaline liquor containing sodium hydroxide and sodium sulfide as main components and 10 mass % of an alkaline cooking liquor containing sodium hydroxide and sodium sulfide as main components but not subjected to electrolytic oxidation and which contains 85 mass % of sulfur and 72 mass % of effective alkali relative to the amount of the alkaline cooking liquors to be introduced into the cooking system.

As a second cooking liquor, an alkaline cooking liquor having 10.2% sulfidity which is obtained by mixing an amount of a cathode liquor obtained by electrolysis, with 10 mass % of a remaining alkaline liquor which was not used for electrolysis was added to the bottom of the upper cooking zone so that effective alkali were at 21 mass % relative to the total amount of the alkaline cooking liquors introduced into the cooking system. As a third cooking liquor, the cooking liquor was added to the bottom of the cooking/washing zone so that effective alkali were at 7 mass % relative to the total amount introduced into the cooking system.

The results of the cooking of Comparative Example 3 are shown in Table 2.

Example 4

Using hardwood chips obtained by mixing 30 mass % of *acacia,* 30 mass % of oak and 40 mass % of *eucalyptus*, each on a bone-dry weight basis, cooking was carried out by use of a continuous digester shown in FIG. 1. Three total effective alkali addition rates (relative to bone-dry chips; converted to $Na_2O$) of 11.9, 12.8 and 13.6 mass % were used.

Example 1 was repeated with respect to the electrolyzer used for electrolysis, the cooking black liquor extraction from the upper and lower extraction strainers, and the addition of the quinone compound. The preparation methods, formulation and manner of addition of the first, second and third cooking liquors used for the cooking were similar to those of Example 1. The liquor ratio to the bone-dry chips was at about 2.5 L/kg as combined along with the moisture carried in with the chips.

The cooking was performed to an H-factor of 830 by heating the top zone from 120° C.~140° C. in 20 minutes over from the top of the top zone to the bottom, keeping at 152° C. for 30 minutes in the upper cooking zone, keeping at 152° C. for 120 minutes in the lower cooking zone, and lowering the temperature of from 156° C.~140° C. in 140 minutes over from the top of the cooking/washing zone to the bottom. The results of the cooking of Example 4 are shown in Table 3.

Example 5

This example was carried out in the same manner as in Example 1 with respect to the electrolyzer used for electrolysis, the cooking black liquor extraction from the upper and lower extraction strainers and the addition of the quinone compound. This example was also carried out in the same manner as in Example 4 with respect to the chips used for cooking, the total effective alkali addition rates, the liquor ratios, the temperatures, times and H-factor of the digester and the addition of the quinone compound. The preparation method and formulations, and the manner of addition of the first, second and third cooking liquors used for the cooking were similar to those of Example 2. The results of the cooking of Example 5 are shown in Table 3.

Example 6

This example was carried out in the same manner as in Example 1 with respect to the electrolyzer used for electrolysis, the cooking black liquor extraction from the upper and lower extraction strainers and the addition of the quinone compound. The chips used for cooking, the total effective alkali addition rates, the liquor ratios, the temperatures, times and H-factor of the digester and the addition of the quinone compound were carried out in the same manner as in Example 4. The preparation method and formulations, and the manner of addition of the first, second and third cooking liquors used for the cooking were similar to those of Example 3. The results of the cooking of Example 6 are shown in Table 3.

Comparative Example 4

This example was carried out in the same manner as in Example 1 with respect to the electrolyzer used for electrolysis, the cooking black liquor extraction from the upper and lower extraction strainers and the addition of the quinone compound. The chips used for cooking, the total effective alkali addition rates, the liquor ratios, the temperatures, times and H-factor of the digester and the addition of the quinone compound were carried out in the same manner as in Example 4. The preparation method and formulations, and the manner of addition of the first, second and third cooking liquors used for the cooking were similar to those of Comparative Example 1. The results of the cooking of Comparative Example 4 are shown in Table 4.

Comparative Example 5

This example was carried out in the same manner as in Example 1 with respect to the electrolyzer used for electrolysis, the cooking black liquor extraction from the upper and lower extraction strainers and the addition of the quinone compound. The chips used for cooking, the total effective alkali addition rates, the liquor ratios, the temperatures, times and H-factor of the digester and the addition of the quinone compound were carried out in the same manner as in Example 4. The preparation method and formulations, and the manner of addition of the first, second and third cooking liquors used for the cooking were similar to those of Comparative Example 2. The results of the cooking of Comparative Example 5 are shown in Table 4.

Comparative Example 6

This example was carried out in the same manner as in Example 1 with respect to the electrolyzer used for electrolysis, the cooking black liquor extraction from the upper and lower extraction strainers and the addition of the quinone compound. The chips used for cooking, the total effective alkali addition rates, the liquor ratios, the temperatures, times and H-factor of the digester and the addition of the quinone compound were carried out in the same manner as in Example 4. The preparation method and formulations, and the manner of addition of the first, second and third cooking liquors used for the cooking were similar to those of Comparative Example 3. The results of the cooking of Comparative Example 6 are shown in Table 4.

With respect to the results of cooking of the lignocellulose materials making use of softwood chips in Examples 1-3 and Comparative Examples 1-3, Example 1 and Comparative Example 1, Example 2 and Comparative Example 2, and Example 3 and Comparative Example 3 are compared with each other. In any case where polysulfide sulfur concentrations, converted to sulfur, are, respectively, at 4 g/L, 8 g/L and 10 g/L in the total alkaline cooking liquors, Examples 1-3 (Table 1), in which the first alkaline cooking liquors containing polysulfide are added in such a way that the sulfur content is at 100 mass % relative to its total amount introduced into the cooking system, are improved in pulp yield at the same Kappa number and are simultaneously reduced in effective alkali addition rate at the same Kappa number over Comparative Examples 1-3 (Table 2) wherein sulfur contents in the first alkaline cooking liquors are less than 99% relative to the total amount introduced into the cooking system, and remaining sulfur is added as contained in the second and third cooking liquors.

More particularly, it will be seen that wood resources can be effectively utilized and the specific chemical consumption can be saved.

As to the results of the cooking of lignocellulose materials making use of hardwoods in Examples 4-6 and Comparative Examples 4-6, Example 4 and Comparative Examples 4, Example 5 and Comparative Examples 5, and Example 6 and Comparative Examples 6 are compared with each other. In any case where polysulfide sulfur concentrations, converted to sulfur, are, respectively, at 4 g/L, 8 g/L and 10 g/L in the total alkaline cooking liquors, Examples 4-6 (Table 3), in which the first alkaline cooking liquors containing polysulfide are added in such a way that the sulfur content is at 100 mass % relative to the total amount introduced into the cooking system, are improved in pulp yield at the same Kappa number and are reduced in effective alkali addition rate at the same Kappa number over Comparative Examples 4-6 wherein sulfur contents in the first alkaline cooking liquors are less than 99% relative to the total amount introduced into the cooking system, and remaining sulfur is added as contained in the second and third cooking liquors.

More particularly, it will be seen that wood resources can be effectively utilized and the specific chemical consumption can be saved.

TABLE 1

| Example/Comparative Example No. | Example 1 | | | Example 2 | | | Example 3 | | |
|---|---|---|---|---|---|---|---|---|---|
| Wood chips | Softwood mixture | | | Softwood mixture | | | Softwood mixture | | |
| Total effective alkali addition rate (wt % based on bone-dry chips, as converted to $Na_2O$) | 14.5 | 16.5 | 18.5 | 14.5 | 16.5 | 18.5 | 14.5 | 16.5 | 18.5 |
| Addition/extraction place | | | | | | | | | |
| Polysulfide concentration (g/L) in alkaline cooking liquor | 4 | | | 8 | | | 10 | | |
| Split ratio (wt %) of effective alkali to the total amount introduced into cooking system | 94 | | | 85 | | | 80 | | |
| Effective alkali addition rate (wt % based on bone-dry chips) | 13.8 | 15.7 | 17.6 | 12.3 | 14.0 | 15.7 | 11.6 | 13.2 | 14.8 |
| Split ratio of sulfur to total amount introduced into cooking system (wt %) | 100 | | | 100 | | | 100 | | |
| Ratio of extracted black liquor to total cooking black liquor (volume % based on total black liquor) | 45 | | | 45 | | | 45 | | |
| Split ratio of effective alkali to total amount introduced into cooking system (wt %) | 4.5 | | | 11.2 | | | 15 | | |
| Effective alkali addition rate (wt % based on bone-dry chips) | 0.7 | 0.7 | 0.8 | 1.6 | 1.8 | 2.1 | 2.2 | 2.5 | 2.8 |
| Sulfidity (%) | 0 | | | 0 | | | 0 | | |
| Ratio of extracted black liquor to total amount introduced into cooking system (wt %) | 55 | | | 55 | | | 55 | | |

TABLE 1-continued

| | Example/Comparative Example No. | Example 1 | | | Example 2 | | | Example 3 | | |
|---|---|---|---|---|---|---|---|---|---|---|
| 9 | Split ratio of effective alkali to total amount introduced into cooking system (wt %) | 1.5 | | | 3.8 | | | 5 | | |
| | Effective alkali addition rate (wt % based on bone-dry chips) | 0.2 | 0.2 | 0.3 | 0.6 | 0.6 | 0.7 | 0.7 | 0.8 | 0.9 |
| | Sulfidity (%) | 0 | | | 0 | | | 0 | | |
| H-factor | | 1400 | | | 1400 | | | 1400 | | |
| Results of cooking | Pulp yield (%) | 47.2 | 46.4 | 45.5 | 48.6 | 47.5 | 46.0 | 48.8 | 47.6 | 46.2 |
| | Kappa number | 33.2 | 26.5 | 23.3 | 30.6 | 25.4 | 22.8 | 29.2 | 24.7 | 22.5 |
| | Pulp yield at Kappa number of 25 (%) | 46.0 | | | 47.3 | | | 47.7 | | |
| | Effective alkali addition rate at the Kappa number of 25 (wt % based on bone-dry chips, as converted to $Na_2O$) | 17.4 | | | 16.8 | | | 16.4 | | |

TABLE 2

| | Example/Comparative Example No. | Comparative Example 1 | | | Comparative Example 2 | | | Comparative Example 3 | | |
|---|---|---|---|---|---|---|---|---|---|---|
| Wood chips | | Softwood mixture | | | Softwood mixture | | | Softwood mixture | | |
| Total effective alkali addition rate (wt % based on bone-dry chips, as converted to $Na_2O$) | | 14.5 | 16.5 | 18.5 | 14.5 | 16.5 | 18.5 | 14.5 | 16.5 | 18.5 |
| Addition/extraction place | | | | | | | | | | |
| 3 | Polysulfide concentration (g/L) in alkaline cooking liquor | 4 | | | 8 | | | 10 | | |
| | Split ratio (wt %) of effective alkali to the total amount introduced into cooking system | 85 | | | 75 | | | 72 | | |
| | Effective alkali addition rate (wt % based on bone-dry chips) | 12.3 | 14.0 | 15.7 | 10.9 | 12.4 | 13.9 | 10.4 | 11.9 | 13.3 |
| | Split ratio of sulfur to total amount introduced into cooking system (wt %) | 91 | | | 87 | | | 85 | | |
| 10 | Ratio of extracted black liquor to total cooking black liquor (volume % based on total black liquor) | 45 | | | 45 | | | 45 | | |
| 8 | Split ratio of effective alkali to total amount introduced into cooking system (wt %) | 11.2 | | | 18.7 | | | 21 | | |
| | Effective alkali addition rate (wt % based on bone-dry chips) | 1.6 | 1.8 | 2.1 | 2.7 | 3.1 | 3.5 | 3.0 | 3.5 | 3.9 |
| | Sulfidity (%) | 15.9 | | | 12.4 | | | 10.2 | | |
| 11 | Ratio of extracted black liquor to total amount introduced into cooking system (wt %) | 55 | | | 55 | | | 55 | | |
| 9 | Split ratio of effective alkali to total amount introduced into cooking system (wt %) | 3.8 | | | 6.3 | | | 7 | | |
| | Effective alkali addition rate (wt % based on bone-dry chips) | 0.6 | 0.6 | 0.7 | 0.9 | 1.0 | 1.2 | 1.0 | 1.2 | 1.3 |
| | Sulfidity (%) | 15.9 | | | 12.4 | | | 10.2 | | |
| H-factor | | 1400 | | | 1400 | | | 1400 | | |
| Results of cooking | Pulp yield (%) | 46.8 | 46.1 | 45.2 | 48.1 | 47.4 | 45.8 | 48.5 | 47.6 | 46.0 |
| | Kappa number | 35.9 | 27.2 | 24 | 32.8 | 26.1 | 22.9 | 29.5 | 25.3 | 22.6 |
| | Pulp yield at Kappa number of 25 (%) | 45.5 | | | 46.9 | | | 47.4 | | |
| | Effective alkali addition rate at the Kappa number of 25 (wt % based on bone-dry chips, as converted to $Na_2O$) | 17.9 | | | 17.2 | | | 16.7 | | |

TABLE 3

| | Example/Comparative Example No. | Example 4 | | | Example 5 | | | Example 6 | | |
|---|---|---|---|---|---|---|---|---|---|---|
| Wood chips | | Hardwood mixture | | | Hardwood mixture | | | Hardwood mixture | | |
| Total effective alkali addition rate (wt % based on bone-dry chips, as converted to $Na_2O$) | | 11.9 | 12.8 | 13.6 | 11.9 | 12.8 | 13.6 | 11.9 | 12.8 | 13.6 |
| Addition/extraction place | | | | | | | | | | |
| 3 | Polysulfide concentration (g/L) in alkaline cooking liquor | 4 | | | 8 | | | 10 | | |
| | Split ratio (wt %) of effective alkali to the total amount introduced into cooking system | 94 | | | 85 | | | 80 | | |

TABLE 3-continued

| | Example/Comparative Example No. | Example 4 | | | Example 5 | | | Example 6 | | |
|---|---|---|---|---|---|---|---|---|---|---|
| | Effective alkali addition rate (wt % based on bone-dry chips) | 11.2 | 12.0 | 12.8 | 10.1 | 10.9 | 11.6 | 9.5 | 10.2 | 10.9 |
| | Split ratio of sulfur to total amount introduced into cooking system (wt %) | | 100 | | | 100 | | | 100 | |
| 10 | Ratio of extracted black liquor to total cooking black liquor (volume % based on total black liquor) | | 45 | | | 45 | | | 45 | |
| 8 | Split ratio of effective alkali to total amount introduced into cooking system (wt %) | | 4.5 | | | 11.2 | | | 15 | |
| | Effective alkali addition rate (wt % based on bone-dry chips) | 0.5 | 0.6 | 0.6 | 1.3 | 1.4 | 1.5 | 1.8 | 1.9 | 2.0 |
| | Sulfidity (%) | | 0 | | | 0 | | | 0 | |
| 11 | Ratio of extracted black liquor to total amount introduced into cooking system (wt %) | | 55 | | | 55 | | | 55 | |
| 9 | Split ratio of effective alkali to total amount introduced into cooking system (wt %) | | 1.5 | | | 3.8 | | | 5 | |
| | Effective alkali addition rate (wt % based on bone-dry chips) | 0.2 | 0.2 | 0.2 | 0.5 | 0.5 | 0.5 | 0.6 | 0.6 | 0.7 |
| | Sulfidity (%) | | 0 | | | 0 | | | 0 | |
| H-factor | | | 830 | | | 830 | | | 830 | |
| Results | Pulp yield (%) | 54.8 | 53.7 | 52.4 | 55.1 | 54.3 | 53.3 | 55.3 | 54.6 | 53.4 |
| of | Kappa number | 23.3 | 20.1 | 18.0 | 21.3 | 18.6 | 17.6 | 20.3 | 18.2 | 17.3 |
| cooking | Pulp yield at Kappa number of 25 (%) | | 53.6 | | | 54.7 | | | 55.2 | |
| | Effective alkali addition rate at the Kappa number of 25 (wt % based on bone-dry chips, as converted to $Na_2O$) | | 12.8 | | | 12.3 | | | 12.0 | |

TABLE 4

| | Example/Comparative Example No. | Comparative Example 4 | | | Comparative Example 5 | | | Comparative Example 6 | | |
|---|---|---|---|---|---|---|---|---|---|---|
| Wood chips | | Hardwood mixture | | | Hardwood mixture | | | Hardwood mixture | | |
| Total effective alkali addition rate (wt % based on bone-dry chips, as converted to $Na_2O$) | | 11.9 | 12.8 | 13.6 | 11.9 | 12.8 | 13.6 | 11.9 | 12.8 | 13.6 |
| Addition/extraction place | | | | | | | | | | |
| 3 | Polysulfide concentration (g/L) in alkaline cooking liquor | | 4 | | | 8 | | | 10 | |
| | Split ratio (wt %) of effective alkali to the total amount introduced into cooking system | | 85 | | | 75 | | | 72 | |
| | Effective alkali addition rate (wt % based on bone-dry chips) | 10.1 | 10.9 | 11.6 | 8.9 | 9.6 | 10.2 | 8.6 | 9.2 | 9.8 |
| | Split ratio of sulfur to total amount introduced into cooking system (wt %) | | 91 | | | 87 | | | 85 | |
| 10 | Ratio of extracted black liquor to total cooking black liquor (volume % based on total black liquor) | | 45 | | | 45 | | | 45 | |
| 8 | Split ratio of effective alkali to total amount introduced into cooking system (wt %) | | 11.2 | | | 18.7 | | | 21 | |
| | Effective alkali addition rate (wt % based on bone-dry chips) | 1.3 | 1.4 | 1.5 | 2.2 | 2.4 | 2.5 | 2.5 | 2.7 | 2.9 |
| | Sulfidity (%) | | 15.9 | | | 12.4 | | | 10.2 | |
| 11 | Ratio of extracted black liquor to total amount introduced into cooking system (wt %) | | 55 | | | 55 | | | 55 | |
| 9 | Split ratio of effective alkali to total amount introduced into cooking system (wt %) | | 3.8 | | | 6.3 | | | 7 | |
| | Effective alkali addition rate (wt % based on bone-dry chips) | 0.5 | 0.5 | 0.5 | 0.7 | 0.8 | 0.9 | 0.8 | 0.9 | 1.0 |
| | Sulfidity (%) | | 15.9 | | | 12.4 | | | 10.2 | |
| H-factor | | | 830 | | | 830 | | | 830 | |
| Results | Pulp yield (%) | 54.7 | 53.3 | 52.2 | 55.2 | 54.1 | 52.8 | 55.2 | 54.4 | 53.3 |
| of | Kappa number | 25.1 | 21.3 | 19.2 | 22.7 | 19.5 | 17.8 | 21.1 | 18.4 | 17.4 |
| cooking | Pulp yield at Kappa number of 25 (%) | | 52.6 | | | 54.3 | | | 54.9 | |
| | Effective alkali addition rate at the Kappa number of 25 (wt % based on bone-dry chips, as converted to $Na_2O$) | | 13.3 | | | 12.7 | | | 12.3 | |

The invention claimed is:

1. A continuous cooking process for cooking lignocellulose comprising the steps of:

providing a digester having, from the top to the bottom thereof, a top zone, an upper cooking zone, a lower cooking zone, a cooking/washing zone and strainers provided at the bottom of the respective zones;

feeding a first cooking liquor comprising an alkaline cooking liquor containing polysulfide, sodium hydroxide and sodium sulfide or sodium carbonate and sodium sulfide as main components, polysulfide sulfur at a sulfur concentration of 3-20 g/L, not less than 99 mass % of a sulfur component to total sulfur component of cooking activity and 85-95 mass % of effective alkali relative to total effective alkali, respectively, in total amount of alkali cooking liquors to be introduced into the digester, upstream of the top zone of the digester;

feeding a second cooking liquor comprising an alkaline cooking liquor made mainly of sodium hydroxide to the upper cooking zone;

feeding a third cooking liquor comprising an alkaline cooking liquor made mainly of sodium hydroxide to the cooking/washing zone; and withdrawing a cooked pulp from the bottom of the digester, wherein a cooking black liquor is extracted from at least one of the strainers and discharged outside of the digester.

2. The process for cooking a lignocellulose as defined in claim 1, wherein the first cooking liquor contains from 93-95 mass % of effective alkali relative to total effective alkali.

3. The process for cooking a lignocellulose as defined in claim 1, characterized by further feeding 0.01~1.5 mass % of a quinone compound per bone-dry chip to the digester.

4. The process for cooking a lignocellulose as defined in claim 3, characterized in that 0.01~0.15 mass % of the quinone compound per bone-dry chip is fed upstream of the top of the digester or the bottom of the upper cooking zone.

5. The process for cooking a lignocellulose as defined in claim 1, characterized in that the alkaline cooking liquor used as the first cooking liquor contains polysulfide sulfur at a sulfur concentration of 4~15 g/L.

6. The process for cooking a lignocellulose as defined in claim 1, characterized in that the alkaline cooking liquor used as the first cooking liquor contains an anode liquor obtained by electrochemically oxidizing an alkaline solution made mainly of sodium hydroxide and sodium sulfide, or sodium carbonate and sodium sulfide, and an alkaline cooking liquor of an electrochemically non-oxidized alkaline solution made mainly of sodium hydroxide and sodium sulfide, or sodium carbonate and sodium sulfide.

7. The process for cooking a lignocellulose as defined in claim 6, characterized in that, in the first cooking liquor, the anode liquor obtained by electrochemically oxidizing the alkaline solution containing sodium hydroxide and sodium sulfide, or sodium carbonate and sodium sulfide as main components is at least 30 mass % relative to the total amount of the first cooking liquor, and the alkaline cooking liquor of an electrochemically non-oxidized alkaline solution containing sodium hydroxide and sodium sulfide, or sodium carbonate and sodium sulfide as main components is at up to 70 mass % relative to the total amount of the first cooking liquor.

8. The process for cooking a lignocellulose as defined in claim 7, characterized in that the anode liquor obtained by electrochemically oxidizing said alkaline solution containing sodium hydroxide and sodium sulfide or sodium carbonate and sodium sulfide as main components contains 5~20 g/L, as sulfur, of polysulfide sulfur.

9. The process for cooking a lignocellulose as defined in claim 6, characterized in that the surface area of the anode per unit volume of the anode compartment is 500~20,000 $m^2/m^3$.

10. The process for cooking a lignocellulose as defined in claim 9, characterized in that the surface area of the anode is 2~100 $m^2/m^2$ per unit area of a membrane provided between the anode compartment and the cathode compartment.

11. The process for cooking a lignocellulose as defined in claim 1, characterized in that the alkaline cooking liquor used as said second cooking liquor and said third cooking liquor is made of a cathode liquor obtained by electrochemically oxidizing an alkaline solution containing sodium hydroxide and sodium sulfide, or sodium carbonate and sodium sulfide as main components.

* * * * *